United States Patent [19]

Itoh et al.

[11] Patent Number: 4,629,683

[45] **Date of Patent: * Dec. 16, 1986**

[54] PROCESSING SILVER HALIDE PHOTOGRAPHIC MATERIAL WITH BLOCKED AGENT AND HYDROXYLAMINE

[75] Inventors: Isamu Itoh; Mitsunori Ono; Keiji Mihayashi; Seiji Ichijima; Hidetoshi Kobayashi, all of Kanagawa, Japan

[73] Assignee: Fuji Photo Film Co., Ltd., Kanagawa, Japan

[ * ] Notice: The portion of the term of this patent subsequent to Feb. 19, 2002 has been disclaimed.

[21] Appl. No.: 602,645

[22] Filed: Apr. 20, 1984

[30] Foreign Application Priority Data

Apr. 22, 1983 [JP] Japan ..... 58-71883

[51] Int. Cl.[4] ..... G03C 1/40; G03C 5/26; G03C 5/30; G03C 5/38

[52] U.S. Cl. ..... 430/390; 430/218; 430/219; 430/222; 430/223; 430/405; 430/410; 430/428; 430/430; 430/435; 430/445; 430/484; 430/566; 430/955; 430/957; 430/959; 430/960

[58] Field of Search ..... 430/223, 224, 225, 390, 430/391, 392, 393, 503, 504, 505, 561, 562, 563, 219, 240, 566, 382, 383, 405, 435, 445, 960, 484, 428, 430, 955, 957, 959, 218, 222, 410

[56] References Cited

U.S. PATENT DOCUMENTS

| | | | |
|---|---|---|---|
| 4,310,612 | 1/1982 | Mooberry et al. | 430/561 |
| 4,350,752 | 9/1982 | Reczek et al. | 430/566 |
| 4,359,521 | 11/1982 | Fryberg et al. | 430/505 |
| 4,409,323 | 10/1983 | Sato et al. | 430/555 |
| 4,461,826 | 7/1984 | Yamashita et al. | 430/505 |
| 4,500,636 | 2/1985 | Ono et al. | 430/566 |

*Primary Examiner*—Richard L. Schilling
*Attorney, Agent, or Firm*—Sughrue, Mion, Zinn, Macpeak and Seas

[57] ABSTRACT

A method of processing a photographic material which contains a light-sensitive silver halide emulsion layer having associated therewith a blocked photographic agent capable of releasing a photographically useful agent by ring cleavage of a 4- to 7-membered ring containing at least one carbonyl group in the presence of a hydroxylamine, whereby both high stability of the photographic material upon storage and timely release of the photographically useful agent upon processing are achieved.

14 Claims, No Drawings

PROCESSING SILVER HALIDE PHOTOGRAPHIC MATERIAL WITH BLOCKED AGENT AND HYDROXYLAMINE

FIELD OF THE INVENTION

The present invention relates to a method of processing a silver halide photographic material and, more particularly, to a method of processing a silver halide photographic material which contains a precursor compound capable of releasing a photographically useful agent with ring cleavage of a 4- to 7-membered ring having at least one carbonyl group.

BACKGROUND OF THE INVENTION

The manner of prior incorporation of photographically useful agents in a photographic material and thereby to fully achieve their effects differs from the manner in which they are used in processing solutions. For instance, photographic agents of the kind which cannot withstand long-range storage in processing solutions because of their liability to decomposition under acid-alkali or oxidation-reduction conditions can be utilized effectively and, at the same time, the composition of a processing solution can be simplified to facilitate the preparation thereof. Further, in processing a light-sensitive material, it becomes feasible for a desired photographic agent to fulfill its function at a desired time or/and at a desired place, that is to say, only in a specific layer or layers in the vicinity thereof where the light-sensitive material has a multilayer structure, or for a large amount of a desired photographic agent to change as a function of silver halide development. However, if the photographic agent is added to a photographic material in an active form, it undergoes reactions with other components present in the photographic material or decomposes under the influence of heat or oxygen during storage prior to processing. Therefore, it becomes impossible to achieve fully the expected capabilities at the time of processing. One solution to this problem is a method in which a photographic agent is converted into a substantially inactive form by blocking the active group, that is, a precursor thereof, and then, the precursor is added to a photographic material. When a useful photographic agent is a dye, a functional group having a great effect on spectral absorption of the dye is blocked and thereby its spectral absorption is shifted to the shorter or the longer wavelength side. Under this circumstance, even if the blocked dye is also present in a silver halide emulsion layer with a spectral sensitivity in the wavelength region corresponding to the spectral absorption of the original dye, a lowering of sensitivity due to the so-called filter effect does not occur. Therefore, it can be used advantageously. When a photographically useful agent is an antifoggant or a development inhibitor, blocking of the active group can offer many advantages, e.g., desensitization due to adsorption onto light-sensitive silver halide grains and formation of silver salts upon storage can be inhibited, and at the same time, through timely release of such photographic agents, fog can be reduced without impairing photographic speed, fog arising from overdevelopment can be depressed, development can be stopped at a desired time, and so on. When a photographically useful agent is a developer, assistant developer or a fogging agent, blocking the active group or the adsorptive group can offer the advantages that various photographically adverse effects due to conversion into semiquinones or oxidants through air oxidation on storage can be prevented, or injection of electrons into silver halides can be prevented from occurring during storage. Thereby, generation of fog nuclei can be inhibited. This results in the realization of stable processing, and the like. Where a photographically useful agent is a bleach accelerator or a bleachfix accelerator, blocking the active group can offer the advantages that in storing the sensitive material, reactions with other components also present with such an agent can be suppressed, while in processing it, the expected ability can be brought into full play upon removal of the blocking group at the time needed.

As described above, to use a photographic agent in the form of a precursor thereof turns out to be an extremely effective means of freely achieving the ability of the photographic agent. However, precursors thereof have very severe requirements. That is, they must satisfy two contradictory requirements—one requirement being it is stable during storage, and the other requirement being rapid and highly efficient release of the photographic agent by removal of the blocking group at a desired time upon processing.

Several techniques for blocking photographic agents are already known. For example, well-known techniques involve utilization of a blocking group such as an acyl group, a sulfonyl group or the like, as described in Japanese Patent Publication No. 44805/72; utilization of a blocking group which releases a photographic agent due to the so-called reverse Micheal's reaction, as described in Japanese Patent Publication Nos. 39727/79, 9696/80 and 34927/80; utilization of a blocking group which releases a photographic agent by an intramolecular electron transfer accompanying the production of quinonemethide or the analogues thereof, as described in Japanese Patent Publication No. 39727/79 and Japanese Patent Application (OPI) Nos. 135944/82, 135945/82 and 136640/82 (the term "OPI" as used herein refers to a "published unexamined Japanese patent application"); utilization of the intramolecular ring closure reaction described in Japanese Patent Application (OPI) No. 53330/80; utilization of the cleavage of a 5- or 6-membered ring described in Japanese Patent Application (OPI) Nos. 76541/82, 135949/82 and 179842/82; and so on. These known techniques have the disadvantage that those which are stable under storage conditions release photographic agents too slowly at the time of processing and, therefore, they require the processing under high alkalinities of a pH of 12 or above, while those which have sufficiently high release speeds at the time of processing under alkaline conditions of a pH of 9 to 12 decompose slowly under storage conditions thereby impairing their function as a precursor. This disadvantage is believed attributable to the dependence of the release of a photographically useful agent from a blocked photographic agent thereof due to attack of $OH^-$ ion. More specifically, the development processing of generally used silver halide photographic materials is carried out using a developing solution having a pH of 9 to 12, and under these circumstances, a difference in $OH^-$ ion concentration between the time of storage of the photographic material (pH: about 6 to 7) and the time of processing (pH: 9 to 12) ranges from $10^2$ to $10^5$. Accordingly, a blocked photographic agent capable of releasing a photographically useful agent in a half-life period of, e.g., 3 minutes (which means that 3 minutes is required for the amount of the blocked photographic agent to be reduced by decomposition to one-half the amount present thereof) upon processing under the condition of, e.g., pH=10, can be estimated to decompose upon storage under the condition of pH=6 in a half-life period of 3 min$\times 10^4$=30,000 min or 500 hr. This means that half the amount of the blocked photographic agent present decomposes during storage over a period of about three weeks. Consequently, such a blocked agent cannot possibly be suitable for practical use. In addition, although the half-life period of the decomposition upon storage becomes about 30 weeks (10 times the above-described amount) when a blocked photographic agent having a half-life period of 3 minutes with respect to release upon the processing under the condition of pH=11 is employed, even this numerical value of 30 weeks is quite unsatisfactory. This also is difficult for practical use from the viewpoint of maintaining stability.

SUMMARY OF THE INVENTION

Therefore, a first object of the present invention is to provide a widely usable general method which fulfills two contradictory requirements, that is, the requirement that stability under storage conditions is ensured and the requirement of timely release of a photographically useful agent at the time of processing is ensured, which are very difficult points so far as the utilization of precursor compounds of photographically useful agents is concerned.

A second object of the present invention is to provide a method which can effect the timely release of photographic agents on processing under a relatively low alkalinity of a pH of 9 to 12.

A third object of the present invention is to provide a development processing method for a color photographic material by which a high value can be attained in photographic speed to fog ratio.

The above-described objects of the present invention are achieved by a method of processing a silver halide photographic material, which comprises processing, in the presence of hydroxylamines, a photographic material containing a light-sensitive silver halide emulsion layer which has associated therewith a blocked photographic agent capable of releasing a photographically useful agent by a ring cleavage of a 4- to 7-membered ring containing at least one carbonyl group.

DETAILED DESCRIPTION OF THE INVENTION

Specific examples of blocked photographic agent releasing a photographically useful agent by a ring cleavage of a 4- to 7-membered ring containing at least one carbonyl group include compounds represented by the following general formulae (I) to (V) respectively.

(I)

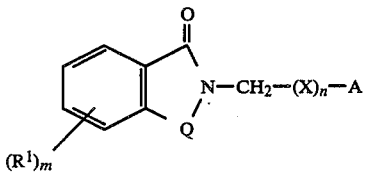

-continued (II)

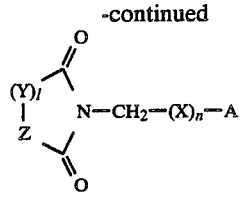

(III)

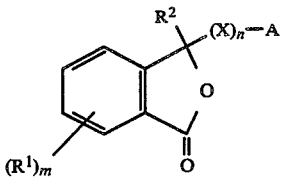

(IV)

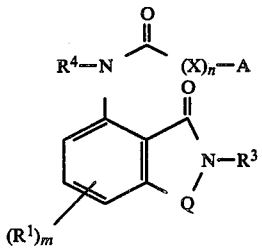

(V)

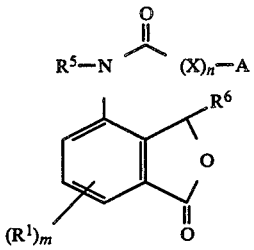

In the formula (I), A represents a photographically useful group which is connected to the blocking group through a hetero atom thereof; Q represents —CO— or —$SO_2$—; X represents a divalent timing group connected to the imidomethyl group through the oxygen atom thereof; $R^1$ represents a substituent group on the phenyl nucleus selected from the group consisting of a halogen atom, an alkyl group, an aryl group, an alkenyl group, an alkoxy group, an aryloxy group, an alkylsulfonyl group, an arylsulfonyl group, a secondary or tertiary amino group, a ureido group, an aminosulfonamido group, a carbamoyl group, a sulfamoyl group, a carbonamido group, a sulfonamido group, a carbamate group, an oxycarbonyl group, an acyloxy group, a carbonate group, an acyl group, a carboxy group, a sulfo group, a cyano group and a nitro group; m represents 0 or an integer of 1 to 4; and n represents 0 or 1.

In the general formula (II), A, X and n have the same meanings as in the general formula (I), respectively; Z represents —$CR^7R^8$—, —O—, —S— or —$NR^9$—; Y represents the non-metal atoms necessary to form a 5- to 7-membered ring; l represents 0 or 1; and $R^7$, $R^8$ and $R^9$ each represents a certain substituent group selected from the group consisting of a hydrogen atom, a chlorine atom, a bromine atom, an alkyl group, an aryl group, an alkoxy group and an aryloxy group.

In the general formula (III), A, X, $R^1$, m and n have the same meanings as in the general formula (I), respectively; and $R^2$ represents a substituent selected from the group consisting of a hydrogen atom, an alkyl group and an aryl group.

In the general formula (IV), A, X, Q, $R^1$, m and n have the same meanings as in the general formula (I), respectively; and $R^3$ and $R^4$ each represents a substituent group on the nitrogen atom selected from the group consisting of an alkyl group, an aryl group, an alicyclic group and a heterocyclic ring residue.

In the general formula (V), A, X, $R^1$, m and n have the same meanings as in the general formula (I), respectively; and $R^5$ and $R^6$ each represents a substituent group and more practically $R^5$ represents a substituent group selected from the group consisting of an alkyl group, an aryl group, an alicyclic group and a heterocyclic ring residue, and $R^6$ represents a substituent group selected from the group consisting of a hydrogen atom, an alkyl group and an aryl group.

A in the general formulae (I) to (V) is a known photographic agent which is substituted by the above-illustrated blocking group at the site of a hetero atom thereof. Specific examples include antifoggants represented by mercaptotetrazoles, mercaptothiadiazoles, benzotriazoles or indazoles; developing agents (or auxiliary developing agents) represented by pyrazolidones, hydroquinones or p-phenylenediamines, fogging agents or nucleating agents, such as hydrazines, hydrazides, quaternary salts or acetylenes; silver halide solvents such as thioethers, hypo or rhodanines; bleach accelerators or blix accelerators; azo dyes; and photographic agents having a redox function which enables the release of photographic agents as described above as a function of development, such as coloring materials for color diffusion transfer photographic materials or DIR compounds.

X in the general formulae (I) to (V) represents a divalent timing group, and it is connected to the methyl group through its oxygen atom. This C-O bond is cleaved upon processing to produce the group —X—A, and A is released rapidly from the resulting group —X—A. Specific examples of linkage group having the above-described function include those which release A upon an intramolecular ring-opening reaction, as described in U.S. Pat. No. 4,248,962; those capable of releasing A by an intramolecular electron transfer, as described in U.S. Pat. Nos. 4,409,323 and 4,421,845; those capable of releasing A by elimination of carbon dioxide, as described in Japanese Patent Application (OPI) No. 179842/82; a divalent timing group of formula —$OCH_2$— capable of releasing A upon elimination of formaldehyde; and so on. Representative examples of the above-described linkage groups suitable for X have the structural formulae illustrated below, respectively.

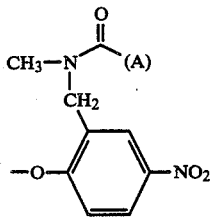

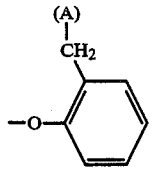

-continued

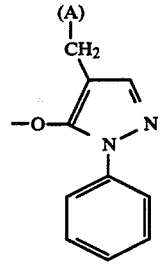

$-O-\underset{\underset{O}{\|}}{C}-(A)$ $-OCH_2-(A)$

The substituent group $R^1$ on the phenyl nucleus in the general formulae (I), (III) (IV) and (V) represents a halogen atom, such as a fluorine, chlorine, bromine, etc. atoms; an alkyl group containing 1 to 20 carbon atoms; an aryl group containing 6 to 26 carbon atoms; an alkenyl group containing 2 to 26 carbon atoms; an alkoxy group containing 1 to 16 carbon atoms; an aryloxy group containing 6 to 26 carbon atoms; an alkylsulfonyl group containing 1 to 20 carbon atoms; an arylsulfonyl group containing 6 to 26 carbon atoms; a secondary or tertiary amino group substituted with an alkyl group containing 1 to 20 carbon atoms or an aryl group containing 6 to 26 carbon atoms; a ureido group, an aminosulfonamido group, a carbamoyl group, a sulfamoyl group, a carbonamido group, a sulfonamido group, a carbamate group, an oxycarbonyl group, an acyloxy group, a carbonate group or an acyl group, which groups each may be substituted with an alkyl group containing 1 to 20 carbon atoms or an aryl group containing 6 to 26 carbon atoms; a carboxy group; a sulfo group, a cyano group; or a nitro group. The above-described alkyl, alkenyl and aryl groups each may be further substituted with some of the above-described various substituent groups. m represents desirably 0, 1 or 2.

Z in the general formula (II) represents —$CR^7R^8$—, —O—, —S— or —$NR^9$—, and forms a 5- or 7-membered ring together with Y, or if l is 0, forms a 4-membered ring. $R^7$, $R^8$ and $R^9$ each represents a hydrogen atom, a chlorine atom, a bromine atom, an alkyl group containing 1 to 20 carbon atoms, an aryl group containing 6 to 26 carbon atoms, an alkoxy group containing 1 to 16 carbon atoms, or an aryloxy group containing 6 to 26 carbon atoms, which groups each may be substituted. Of these groups, —$CR^7R^8$— or —O— is more preferable as Z.

Y represents the non-metal atoms which form a 5- to 7-membered ring together with Z. Specific examples of 5-membered rings formed include succinimide maleimide, oxazolidinone, thiohydantoin, hydantoin, urazole, parabanic acid, etc. Specific examples of 6-membered rings formed include glutarimide, 3-oxyglutarimide, barbituric acid, uracil, benzoxazinedione, etc. Of these rings, preferred rings are succinimide, oxazolidinone, parabanic acid, glutarimide and barbituric acid, and more preferred rings are succinimide and oxazolidinone. As for the 7-membered ring formed, dihydroazepine-2,7-dione is desirable. When l is 0, the 4-membered ring formed is preferably a $\beta$-lactam ring.

$R^2$ in the general formula (III) represents a hydrogen atom, an alkyl group containing 1 to 16 carbon atoms, or an aryl group containing 6 to 26 carbon atoms, which alkyl and aryl groups each may be substituted. Preferably, $R^2$ represents a hydrogen atom or an aryl group containing 6 to 10 carbon atoms.

$R^3$ and $R^4$ in the general formula (IV) respectively represent an alkyl group containing 1 to 16 carbon atoms, an aryl group containing 6 to 26 carbon atoms, an alicyclic group containing 5 to 10 carbon atoms, or a heterocyclic ring residue, each of which may be substituted. More preferably, $R^3$ and $R^4$ each represents an alkyl group containing 1 to 5 carbon atoms, an aryl group containing 6 to 10 carbon atoms, or a substituted or unsubstituted pyridyl group.

$R^5$ in the general formula (V) has the same meaning as $R^3$ and $R^4$ in the general formula (IV), and preferably represents an alkyl group containing 1 to 5 carbon atoms, an aryl group containing 6 to 10 carbon atoms, or a substituted or unsubstituted pyridyl group. $R^6$ in the general formula (V) has the same meaning as $R^2$ in the general formula (III), and preferably represents a hydrogen atom or an aryl group.

Hydroxylamines which can be used in the present invention are represented by the following general formula (VI):

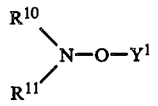

(VI)

In the general formula (VI), $R^{10}$ and $R^{11}$, which may be the same or different, each represents a hydrogen atom, an alkyl group, an alkenyl group, an alkynyl group, an aryl group or a heterocyclic ring residue, or they may combine with each other and form a ring. In addition, $R^{10}$ and $R^{11}$ each may be further substituted with a hydroxylamino group to form a bis compound or a tris compound. $Y^1$ represents a hydrogen atom or a hydrolyzable group. The term "hydrolyzable group" as used herein refers to a group capable of producing a hydroxylamino group upon hydrolysis at the time of development processing, that is to say, a blocking group of a hydroxylamino group. More preferably, $R^{10}$ and $R^{11}$ each is a hydrogen atom, an alkyl group containing 1 to 16 carbon atoms or an aryl group containing 6 to 20 carbon atoms, each of which alkyl and aryl groups may be substituted. Further, $R^{10}$ and $R^{11}$ may form a 5- or 6-membered ring.

When the hydroxylamine represented by the general formula (VI) is used by addition to a processing solution, $Y^1$ represents a hydrogen atom alone, and from consideration of solubility, $R^{10}$ and $R^{11}$ each preferably represents a hydrogen atom or an alkyl group containing 1 to 5 carbon atoms, or they combine with each other and form a pyrrolidine ring, a piperidine ring or a morpholine ring. More desirably, $R^{10}$ and $R^{11}$ each represents a hydrogen atom, a methyl group, an ethyl group, a 2-methoxyethyl group, or a tetrahydro-2-furfuryl group. On the other hand, when the hydroxylamine having a hydrogen atom as $Y^1$ in the general formula (VI) is to be used by incorporation in light-sensitive materials, it is preferred for the total number of carbon atoms present in $R^{10}$ and $R^{11}$ to be about 10 or more from the standpoint of prevention of reaction with precursor compounds upon storage prior to processing. More desirably, $R^{10}$ and $R^{11}$ each is a phenyl, cyclohexyl or octyl group; or $R^{10}$ is a methyl or ethyl group and that $R^{11}$ is a decyl, dodecyl, tetradecyl, hexadecyl or octadecyl group. When incorporated into light-sensitive materials, the hydroxylamines are used more preferably in a blocked form. Since it becomes also feasible to render the blocking group diffusion resistant in this case, using block hydroxylamines is of great advantage.

Detailed reasons why the effect of the present invention the hydroxylamines represented by the general formula (VI) accelerate markedly the release of photographically useful agents from blocked photographic agents represented by, e.g., the general formulae (I) to (V) by cleavage of the 4- to 7-membered rings containing at least one carbonyl group are presently unknown. This effect of the present invention is surprising. On the other hand, as for the mechanisms of releasing photographically useful agents from precursors, U.S. Pat. No. 4,350,752 contains a description of precursors containing the compounds represented by the general formulae (I) and (II), Japanese Patent Application No. 11676/83 (corresponding to U.S. patent application Ser. No. 574,432, filed on Jan. 27, 1984) contains disclosure of precursors containing the compound represented by the general formula (III), and U.S. Pat. No. 4,310,612 contains disclosure of precursors containing the compounds represented by the general formulae (IV) and (V). According to those accounts, unblocking of the compounds represented by the general formulae (I) to (V) is presumed to be based on a ring cleavage due to a nucleophilic attack of $OH^{\ominus}$ ion upon the carbonyl carbon and subsequent electron transfer or an intramolecular ring-closure reaction. If this hypothesis is reasonable, the hydroxylamines represented by the general formula (IV) instead of $OH^{\ominus}$ ion can be interpreted to make a nucleophilic attack upon the carbonyl carbon. As a result, the ring cleavage is accelerated remarkably resulting in the effect of the present invention of unblocking of the compounds represented by the general formulae (I) to (V) being markedly accelerated by the hydroxylamines. However, there is no definite reason why the hydroxylamines are appreciably specific for ring-cleavage type compounds in their effect upon acceleration of the unblocking reaction, and the hydroxylamines are considered to have a characteristic called substrate specificity.

Any of the precursors represented by the general formulae (I) to (V) are heavily influenced by the hydroxylamines represented by the general formula (VI) greatly accelerating their photographically useful agent-releasing reaction. Of these precursors, saccharin derivatives having —$SO_2$— as Q in the general formula (I) (compound represented by the general formula (I') described hereinbelow) and phthalide derivatives represented by the general formula (III) or (V) are particularly heavily influenced by the hydroxylamines in the remarkable acceleration of their release reactions, and have particularly desirable features.

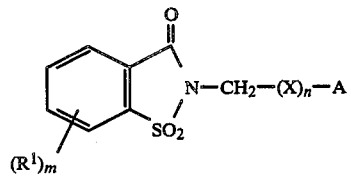

(I')

wherein A, X, $R^1$, m and n each has the same meanings as in the general formula (I).

As can be easily understood from the detailed explanation given above, the present invention is especially useful for general photographic materials which are processed under relatively low pH, ranging from a pH of 9 to pH of 12, where the balance of stability upon storage and timely release of photographically useful agents upon processing has been regarded as quite difficult in principle.

The expression "general photographic material" as used herein is intended to include photographic materials which form images by reducing silver halide grains in emulsions, which possess development centers (latent image or fog nucleus) before the beginning of development, with developing agents obeying Pelz's law, exclusive of those for diffusion transfer processes.

Suitable amounts of the blocked photographic agents of the present invention which are represented by the general formulae (I) to (V) respectively that can be employed depend upon the kind of photographically useful agent released therefrom. In general, appropriate amount of the blocked photographic agent of the invention can be selected from the range of $10^{-9}$ mole to 10 moles per mole of silver due to the kind of photographically useful agent released therefrom. Specifically, a suitable amount of an antifoggant of the mercapto type ranges from $10^{-9}$ to $10^{-1}$ mole, preferably from $10^{-6}$ to $10^{-2}$ mole, per mole of silver; that of an antifoggant of the azole type, such as benzotriazole, ranges from $10^{-8}$ to $10^{-1}$ mole, preferably from $10^{-5}$ to $10^{-2}$ mole, per mole of silver; that of an auxiliary developing agent like a pyrazolidone ranges from $10^{-4}$ to 10 moles, preferably from $10^{-2}$ to 5 moles, per mole of silver; that of a developing agent, such as a hydroquinone, an aminophenol, a p-phenylenediamine, etc., ranges from $10^{-4}$ to 10 moles, preferably from $10^{-2}$ to 5 moles, per mole of silver; that of a fogging agent or a nucleating agent, representative examples of which are hydrazines, hydrazides, quaternary salts, acetylenes and so on, ranges from $10^{-9}$ to $10^{-1}$ mole, preferably $10^{-6}$ to $10^{-2}$ mole, per mole of silver; that of a silver halide solvent such as a thioether, hypo or a rhodanine ranges from $10^{-3}$ to 10 moles, preferably from $10^{-2}$ to 5 moles, per mole of silver; and that of azo dyes and coloring agents for color diffusion transfer photographic materials, respectively, ranges from $10^{-4}$ to 10 moles, preferably from $10^{-2}$ to 1 mole, per mole of silver.

When the hydroxylamines represented by the general formula (VI) are added to a processing solution, a suitable amount thereof ranges from $10^{-3}$ to 1 mole/l, preferably $10^{-2}$ to $5\times10^{-1}$ mole/l. On the other hand, where they are incorporated into a photographic material, a suitable amount of the hydroxylamines therein is adjusted to a range of $10^{-7}$ to 1 mole, preferably $10^{-5}$ to $10^{-1}$ mole, per mole of silver.

Specific examples of precursors represented by the general formulae (I) to (V), respectively, and examples of hydroxylamines represented by the general formula (VI) are illustrated below. However, the present invention should not be construed as being limited to the following examples.

(I)-(1)

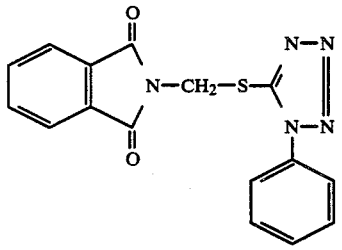

(Compound described in U.S. Pat. No. 4,350,752)

(I)-(2)

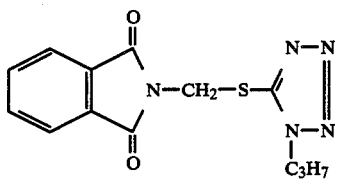

(m.p. 93–94° C.)

(I)-(3)

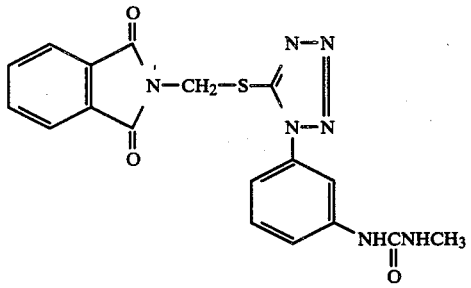

(m.p. 207–208° C.)

(I)-(4)

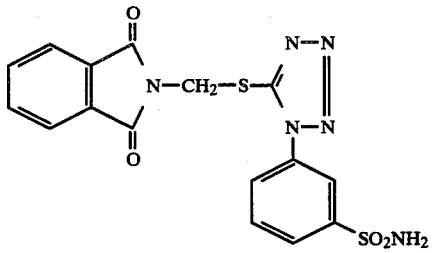

(m.p. 166–166.5° C.)

(I)-(5)

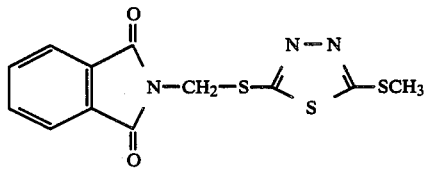

(m.p. 125–126° C.)

(I)-(6)

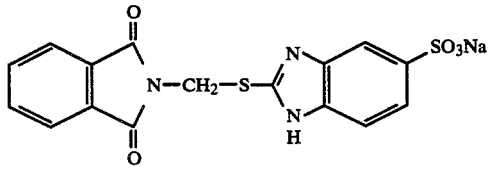

(m.p. 250° C.<)

-continued
(I)-(7)
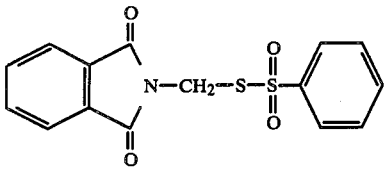
(m.p. 130–132° C.)
(I)-(8)
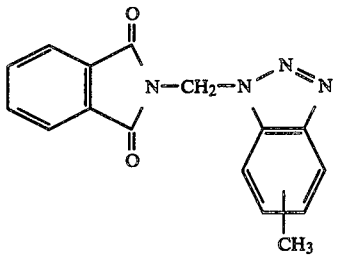
(m.p. 142–145° C.)
(I)-(9)
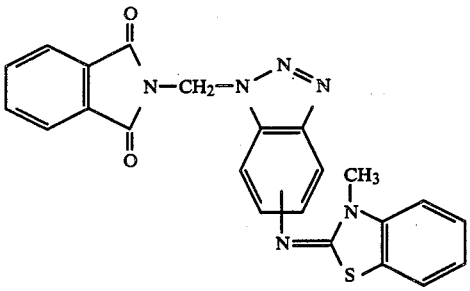
(m.p. 181–183° C.)
(I)-(10)
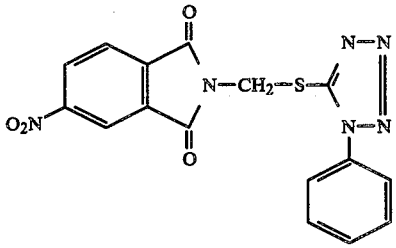
(Compound described in U.S. Pat. No. 4,350,752)
(I)-(11)
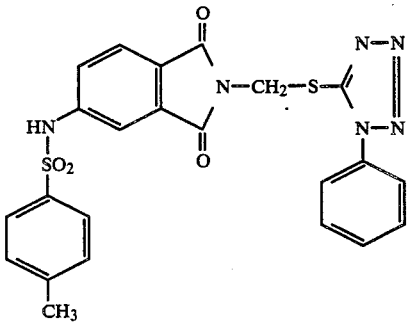
(m.p. 202–204° C.)
(I)-(12)
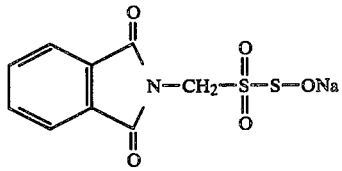
(m.p. 133° C.)
(I)-(13)
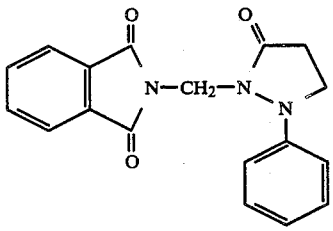
(m.p. 176–180° C.)
(I)-(14)
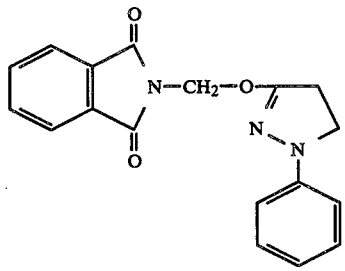
(m.p. 198–207° C.)
(I)-(15)
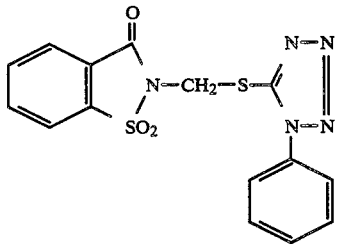
(Compound described in U.S. Pat. No. 4,350,752)
(I)-(16)
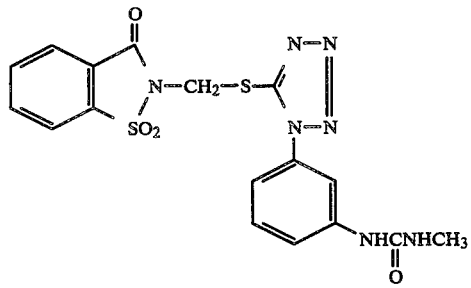
(m.p. 215–217° C.)

-continued
(I)-(17)
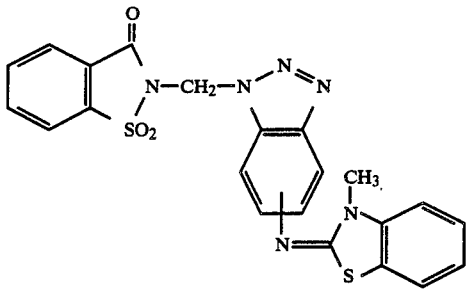
(m.p. 228–230° C.)
(I)-(18)
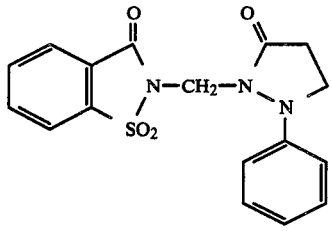
(m.p. 209–213° C.)
(I)-(19)
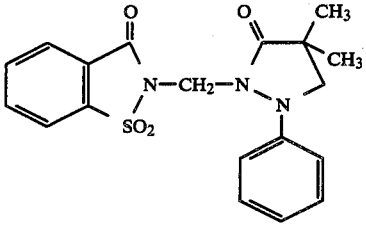
(m.p. 220–223° C.)
(I)-(20)
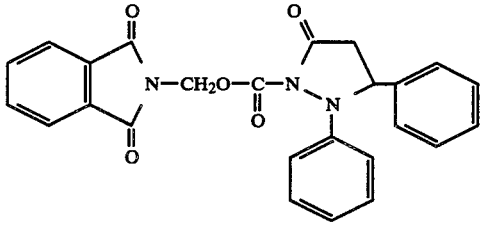
(m.p. 161–163° C.)
(I)-(21)
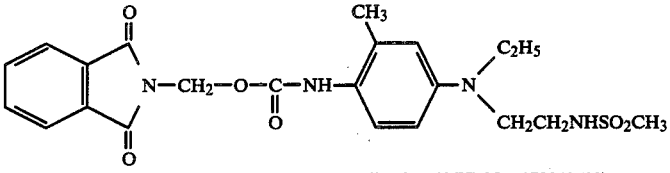
(Compound described in Japanese Patent Application (OPI) No. 179842/82)
(I)-(22)
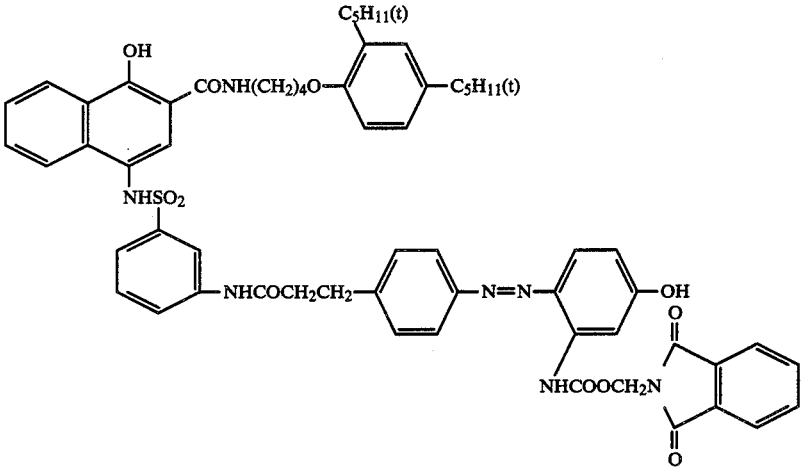
(Compound described in Japanese Patent Application (OPI) No. 179842/82)
(I)-(23)
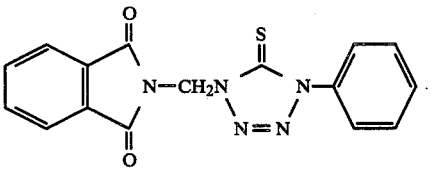
(Compound described in U.S. Pat. No. 4,350,752)
(I)-(24)
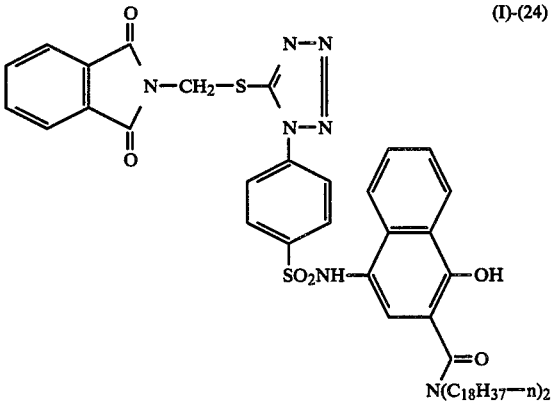
(Compound described in U.S. Pat. No. 4,350,752)

-continued
(II)-(1)
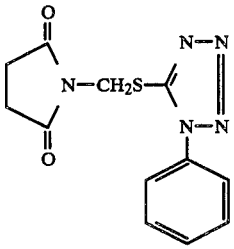
(Compound described in U.S. Pat. No. 4,350,752)
(II)-(2)
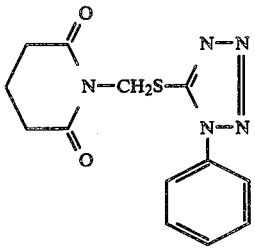
(m.p. 84–85° C.)
(II)-(3)
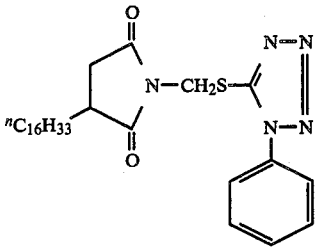
(Compound described in U.S. Pat. No. 4,350,752)
(II)-(4)
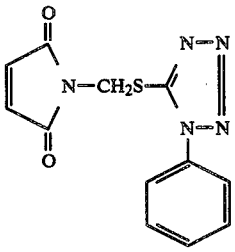
(Compound described in U.S. Pat. No. 4,350,752)
(II)-(5)
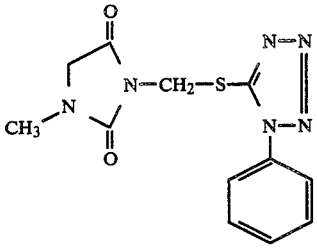
(Compound described in U.S. Pat. No. 4,350,752)
(II)-(6)
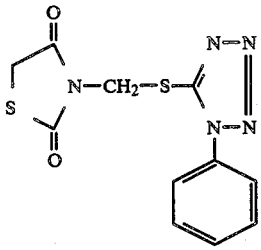
(Compound described in U.S. Pat. No. 4,350,752)
(II)-(7)
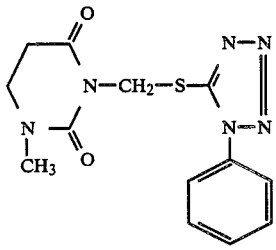
(Compound described in U.S. Pat. No. 4,350,752)
(II)-(8)
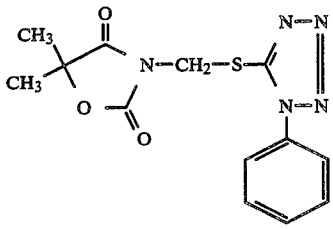
(m.p. 120–121° C.)
(II)-(9)
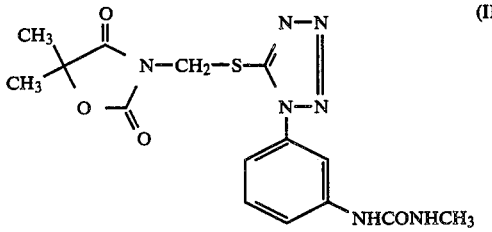
(m.p. 154–155° C.)
(II)-(10)
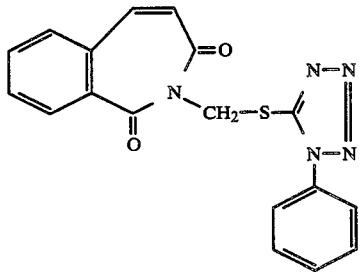
(m.p. 118–121° C.)
(III)-(1)
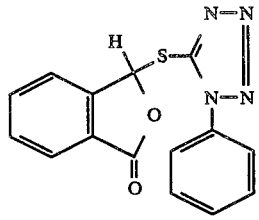
(Compound described in Japanese Patent
(III)-(2)
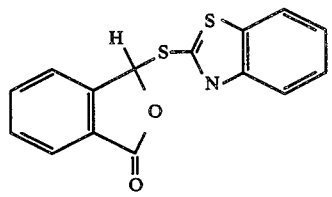
(Compound described in Japanese Patent -continued Application (OPI) No. 76541/82)

(III)-(3)

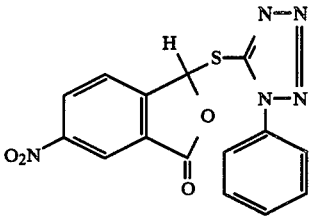

(Compound described in Japanese Patent Application (OPI) No. 76541/82)

Application (OPI) No. 76541/82)

(III)-(4)

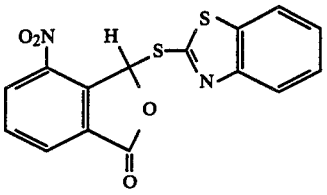

(Compound described in Japanese Patent Application (OPI) No. 76541/82)

(III)-(5)

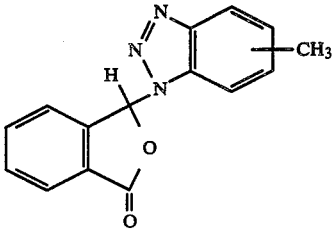

(m.p. 138–140° C.)

(III)-(6)

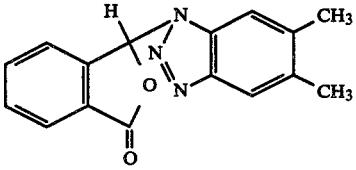

(III)-(7)

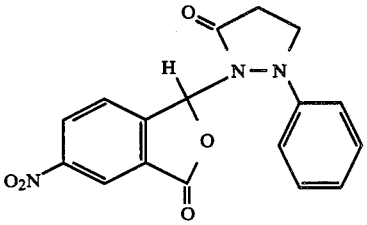

(III)-(8)

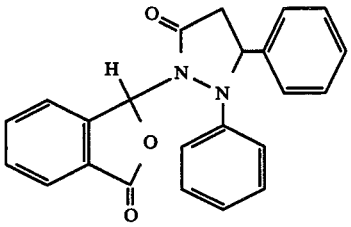

(m.p. 149–152° C.)

(III)-(9)

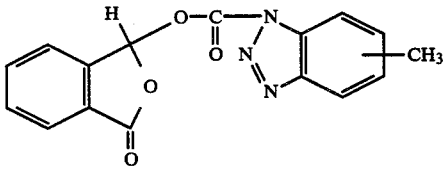

(m.p. 128–131° C.)

(III)-(10)

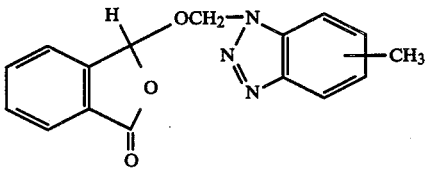

(m.p. 133–135° C.)

(III)-(11)

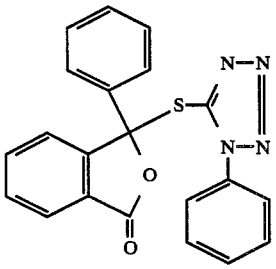

(Compound described in Japanese Patent Application No. 11676/83 corresponding to U.S. Pat. Application Serial No. 574,432, filed on January 27, 1984)

(III)-(12)

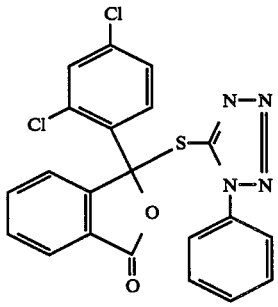

(Compound described in Japanese Patent Application No. 11676/83, corresponding to U.S. Pat. Application Serial No. 574,432, filed on January 27, 1984)

-continued (III)-(13)

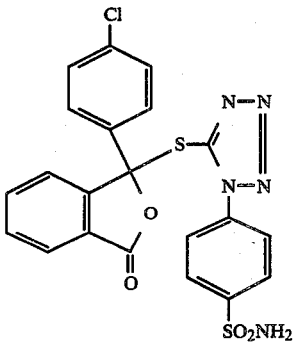

(Compound described in Japanese Patent Application No. 11676/83, corresponding to U.S. Pat. Application Serial No. 574,432, filed on January 27, 1984)

(III)-(14)

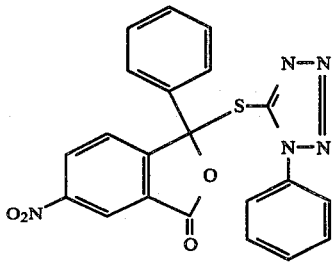

(Compound described in Japanese Patent Application No. 11676/83, corresponding to U.S. Pat. Application Serial No. 574,432, filed on January 27, 1984)

(III)-(15)

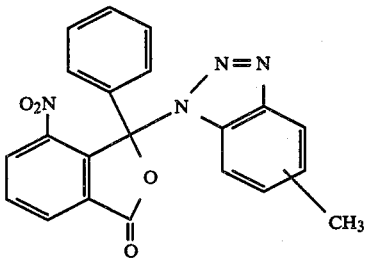

(Compound described in Japanese Patent Application No. 11676/83, corresponding to U.S. Pat. Application Serial No. 574,432, filed on January 27, 1984)

(III)-(16)

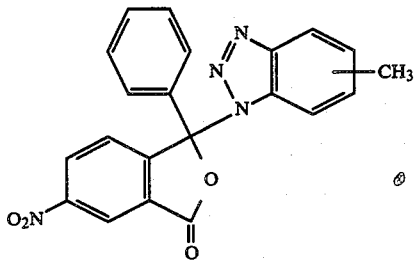

(Compound described in Japanese Patent Application No. 11676/83, corresponding to U.S. Pat. Application Serial No. 574,432, filed on January 27, 1984)

(III)-(17)

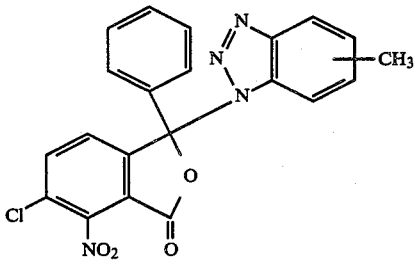

(Compound described in Japanese Patent Application No. 11676/83, corresponding to U.S. Pat. Application Serial No. 574,432, filed on January 27, 1984)

(III)-(18)

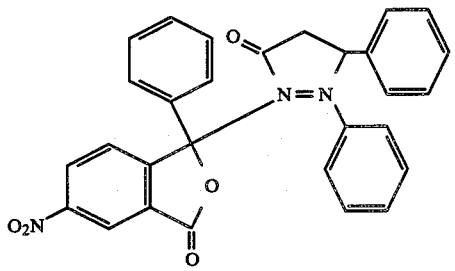

(Compound described in Japanese Patent Application No. 11676/83, corresponding to U.S. Pat. Application Serial No. 574,432, filed on January 27, 1984)

(III)-(19)

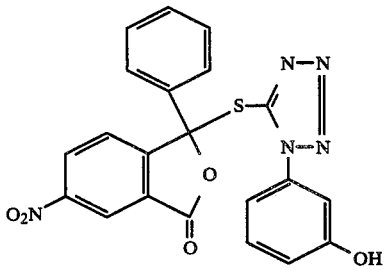

(Compound described in Japanese Patent Application No. 11676/83, corresponding to U.S. Pat. Application Serial No. 574,432, filed on January 27, 1984)

(III)-(20)

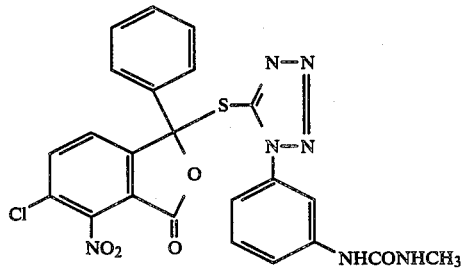

(Compound described in Japanese Patent Application No. 11676/83, corresponding to U.S. Pat. Application Serial No. 574,432, filed on January 27, 1984)

-continued
(IV)-(1)
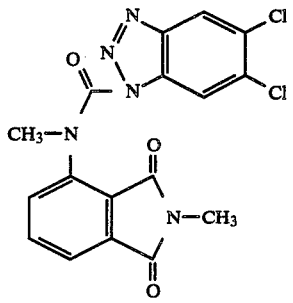
(Compound described in U.S. Pat. No. 4,310,612)
(IV)-(2)
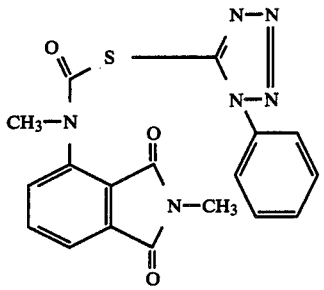
(Compound described in U.S. Pat. No. 4,310,612)
(IV)-(3)
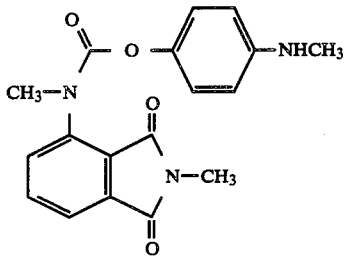
(Compound described in U.S. Pat. No. 4,310,612)
(IV)-(4)
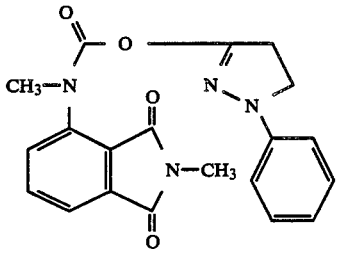
(Compound described in U.S. Pat. No. 4,310,612)
(IV)-(5)
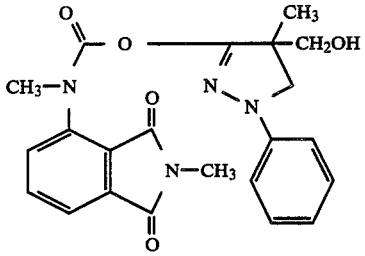
(Compound described in U.S. Pat. No. 4,310,612)
(IV)-(6)
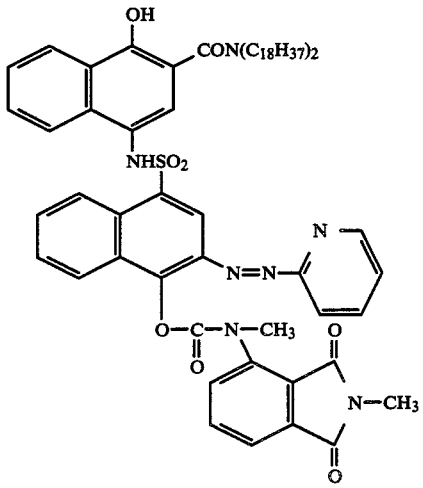
(Compound described in U.S. Pat. No. 4,310,612)
(IV)-(7)
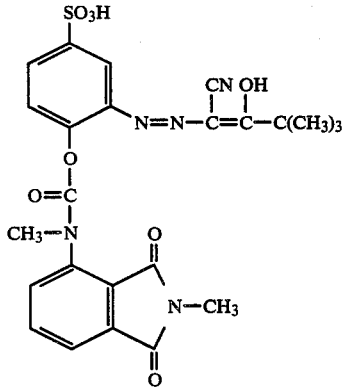
(Compound described in U.S. Pat. No. 4,310,612)
(IV)-(8)
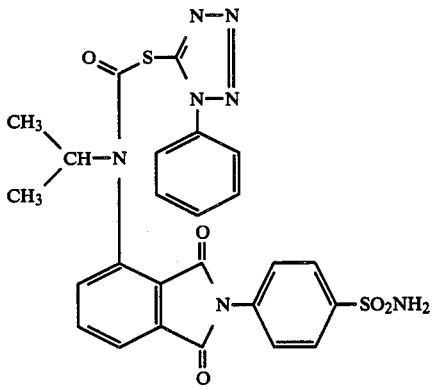
(Compound described in U.S. Pat. No. 4,310,612)

-continued
(V)-(1)
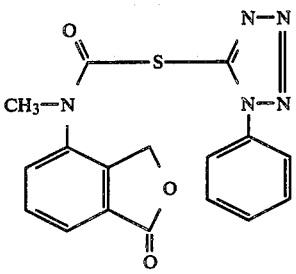
(Compound described in U.S. Pat. No. 4,310,612)
(V)-(2)
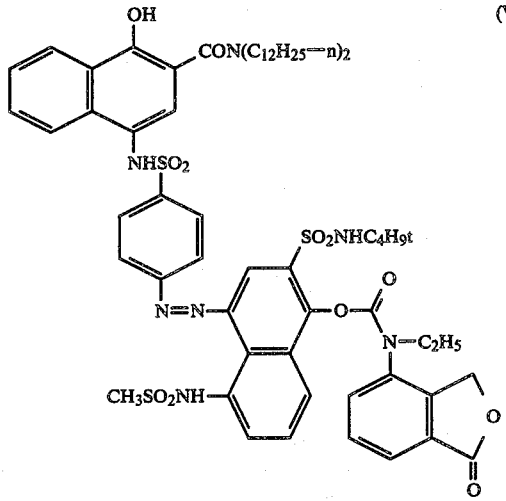
(Compound dexcribed in U.S. Pat. No. 4,310,612)
(V)-(3)
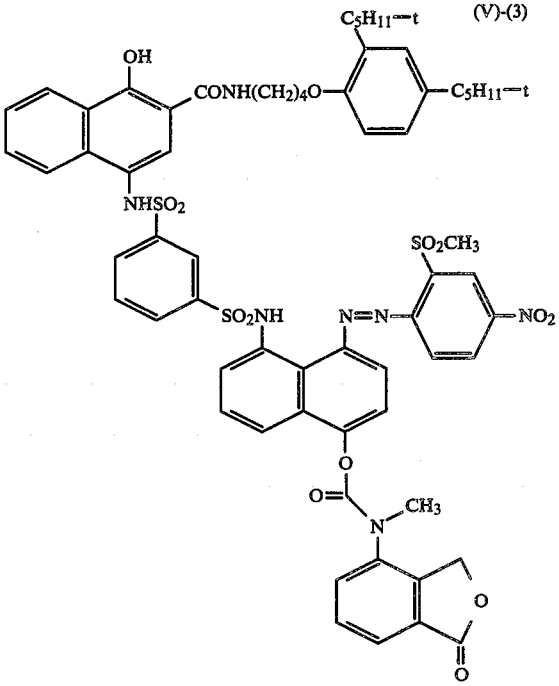
(Compound described in U.S. Pat. No. 4,310,612)
$NH_2OH.HCl$ (VI)-(1)
$NH_2OH.\frac{1}{2}H_2SO_4$ (VI)-(2)
$CH_3NHOH.HCl$ (VI)-(3)
(VI)-(4)
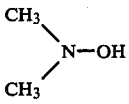
(VI)-(5)
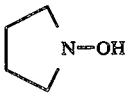
(VI)-(6)
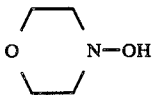
$(CH_3OCH_2CH_2)_2N{-}OH$ (VI)-(7)
$(HOCH_2CH_2)_2N{-}OH$ (VI)-(8)
(VI)-(9)
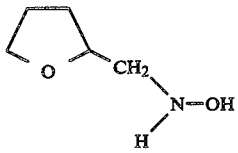

-continued
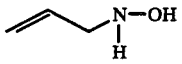
(VI)-(10)
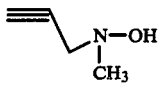
(VI)-(11)
$nC_4H_9NHOH$ (VI)-(12) $nC_8H_{17}NHOH$ (VI)-(13)
(VI)-(14)
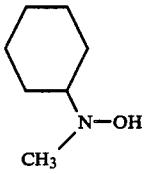
(VI)-(15)
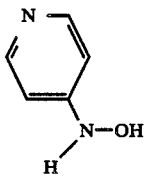
(VI)-(16)
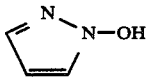
(VI)-(17)
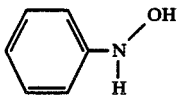
(VI)-(18)
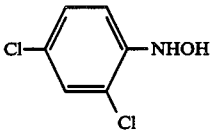
(VI)-(19)
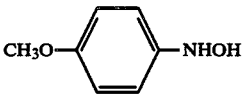
(VI)-(20)
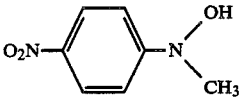
$(^nC_8H_{17})_2N—OH.HClO_4$ (VI)-(21)
$(^nC_{12}H_{25})_2N—OH.\frac{1}{2}H_2SO_4$ (VI)-(22)
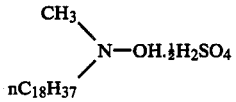
(VI)-(23)
$^nC_{16}H_{37}NHOH.HCl$ (VI)-(24)
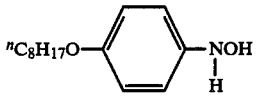
(VI)-(25)
(VI)-(26)
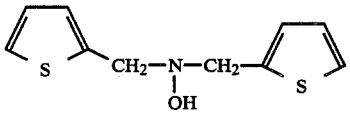
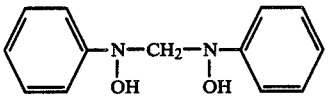
(VI)-(27)
(VI)-(28)
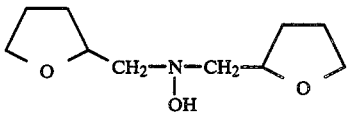
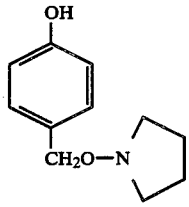
(VI)-(29)
(VI)-(30)
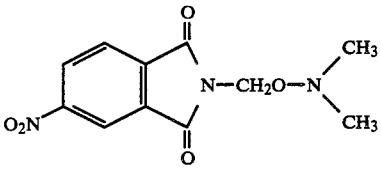
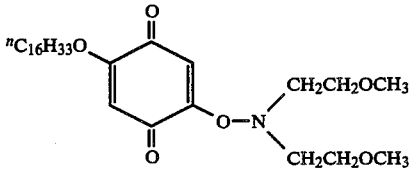
(VI)-(31)
(VI)-(32)
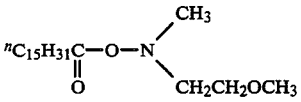
Methods for synthesizing the compounds represented by the general formulae (I) to (V) respectively in general, and specific synthesis examples of specific compounds thereof are disclosed in the following patent specifications.

The compounds represented by the general formula (I) and the compounds represented by the general formula (II) can be synthesized according to the descriptions in U.S. Pat. No. 4,350,752 and Japanese Patent Application (OPI) No. 179842/82.

The compounds represented by the general formula (III) can be synthesized according to the descriptions in Japanese Patent Application (OPI) No. 76541/82, and Japanese Patent Application No. 11676/83 (corresponding to U.S. patent application Ser. No. 574,432, filed on Jan. 27, 1984).

The compounds represented by the general formula (IV) and the compounds represented by the general formula (V) can be synthesized according to the descriptions in U.S. Pat. No. 4,310,612.

All of specific compounds illustrated in the present invention can be synthesized according to the synthesis methods described in the above-described patent specifications, and as for the compounds for which no specific descriptions are given in the above-described patent specifications, their own melting points are written in addition to their respective structural formulae set forth above.

Some of the hydroxylamines represented by the general formula (VI) can be easily obtained not only from commercial sources but also by syntheses according to the methods described in the literatures set forth below. For instance, oxidation of amines as described in B. C. Challis & A. R. Butler, *The Chemistry of the Amino Group*, pp. 320–338, Interscience Publishers, New York (1968); reduction of oximes as described in H. Feuer & B. F. Vincent, *Journal of American Chemical Society*, Vol. 84, p. 3771 (1962); Cope reaction of amineoxides as described in A. C. Cope & E. R. Trumbull, *Organic Reactions*, Vol. 11, p. 317–493 (1960); addition reactions of hydroxylamine to olefins as described in M. S. Gibson, *The Chemistry of the Amino Group*, pp. 61–65, Interscience Publishers, New York (1968); replacement reactions of active halides and hydroxylamines as described in U.S. Pat. No. 3,491,151; and so on are well known as general synthesis methods for hydroxylamines.

In addition, specific description of hydroxylamines are given in U.S. Pat. Nos. 3,864,131, 3,287,124, 3,287,125, 3,293,034, 3,405,034 and 3,455,916.

Some of the carbonyl group-containing 4- to 7-membered ring precursor compounds represented by the general formulae (I) to (V) which can be employed in the present invention were selected and specific synthesis examples thereof are illustrated in detail below. Unless otherwise indicated herein, all parts, percents, ratios and the like are by weight.

SYNTHESIS EXAMPLE 1

Synthesis of Compound (I)-(11)

(1) Synthesis of 4-Aminophthalimide:

Commercially available 4-nitrophthalimide (38.4 g), reduced iron (80 g) and ammonium chloride (1.5 g) were added to a mixture of isopropyl alcohol (400 ml), water (40 ml) and acetic acid (4 ml), and the mixture was heated with stirring for 1 hour over a steam bath. The resulting solid was separated from the hot solution by filtration, and washed with 300 ml each of acetone three times while hot. The solvent was removed from the collected filtrates using a rotary evaporator. The thus obtained crude crystals were recrystallized from a methanol/acetone mixture. Yield: 17.2 g, Melting Point 250° C.<.

(2) Synthesis of 4-(p-Toluenesulfonamido)phthalimide:

4-Aminophthalimide (16.1 g) and pyridine (8.9 ml) were added to dimethyl acetamide (100 ml), and the mixture was kept at about 5° C. using ice-cold water. Thereto, p-toluenesulfonyl chloride (19 g) was added dropwise over an about 10 minute period. After the conclusion of dropwise addition, the stirring was continued at room temperature for about 30 minutes, and further continued at room temperature for 1 hour. The resulting reaction mixture was poured into ice-cold water (500 ml), and the thus produced precipitate was filtered off, and recrystallized from methanol. Yield: 29 g, Melting Point: 250° C.<.

(3) Synthesis of N-Hydroxymethyl-4-(p-toluenesulfonamido)phthalimide:

4-(p-Toluenesulfonamido)phthalimide (28.7 g) and a 35% formaldehyde aqueous solution (70 ml) were added to a mixed solvent of water (70 ml) and dioxane (250 ml), and heated at about 100° C. for 7 hours over an oil bath. The reaction mixture was cooled to room temperature, and poured into ice-cold water for separation of crystals. Then, the crystals thus precipitated were recovered by filtration. Yield: 24.3 g, Melting Point: 190° C. (decomposed).

(4) Synthesis of N-Bromomethyl-4-(p-toluenesulfonamido)phthalimide:

N-Hydroxymethyl-4-(p-toluenesulfonamido)phthalimide (17.3 g) and phosphorus tribromide (1.6 ml) were added to benzene (200 ml), and heated at about 80° C. for 1 hour. The reaction mixture was cooled for separation of crystals. The crystals thus precipitated were filtered off, and recrystallized from methanol/ethyl acetate mixture. Yield: 13 g, Melting Point: 185°–188° C.

(5) Synthesis of Compound (I)-(11):

N-Bromomethyl-4-(p-toluenesulfonamido)phthalimide (13 g) was dissolved in tetrahydrofuran (200 ml) and thereto a tetrahydrofuran solution (100 ml) of the sodium salt of 5-mercapto-1-phenyltetrazole (6 g) was slowly added at room temperature. The reaction mixture was allowed to stand at room temperature for 2 hours. Thereafter, the reaction mixture was poured into ice-cold water, and the crystals precipitated were recovered by filtration to obtain a crude product. The thus obtained crude product was recrystallized from an ethyl acetate/methanol mixed solvent to yield 15.4 g of N-(1-phenyl-5-tetrazolylthiomethyl)-4-(p-toluenesulfonamido)phthalimide. Melting Point: 202°–204° C.

SYNTHESIS EXAMPLE 2

Synthesis of Compound (I)-(13) and Compound (I)-(14)

1-Phenyl-3-pyrazolidinone (8.1 g) and triethylamine (5.1 g) were dissolved in dimethylacetamide (40 ml) and thereto a solution of N-bromomethylphthalimide (12.0 g) in dimethylacetamide (20 ml) was added dropwise over a 30 minute period with stirring under a nitrogen atmosphere at room temperature. The stirring was further continued for 3 hours and thereafter 300 ml of water was added to the reaction mixture. The resulting aqueous mixture was extracted with 100 ml of chloroform. The chloroform layer was washed with 100 ml each of water twice, dried over anhydrous sodium sulfate, and concentrated. The compounds thus produced were separated by passage through a chromatographic column of silica gel using an ethyl acetate/chloroform mixture as a developing solvent, and recrystallized from toluene respectively. Thus, the desired compound, 1-phenyl-2-(N-phthalimidomethyl)-3-pyrazolidinone, (Compound (I)-(13)), was obtained in a yield of 7.1 g, and the other desired compound, 1-phenyl-3-(N-phthalimidomethyloxy)-2-pyrazoline, (Compound (I)-(14)), was obtained in a yeild of 5.5 g. The melting points of Compound (I)-(13) and Compound (I)-(14) were 176°–180° C. and 198°–207° C., respectively. The structures of the isomers (I)-(13) and (I)-(14) were determined with the aid of IR spectra, $^{1}$H-NMR spectra and $^{13}$C-NMR spectra.

SYNTHESIS EXAMPLE 3

Synthesis of Compound (I)-(18)

(1) Synthesis of N-Hydroxymethylsaccharin:

Saccharin (183 g) and a 35% formaldehyde aqueous solution (100 ml) were added to water (200 ml), and heated at 100° C. for 10 hours over an oil bath. The crystals thus precipitated were recovered by filtration to obtain 185 g of the desired compound. Melting Point: 128°–129° C.

(2) Synthesis of N-Bromomethylsaccharin:

N-Hydroxymethylsaccharin (70 g) and phosphorus tribromide (32.7 g) were added to benzene (250 ml), and stirred at about 80° C. for 1 hour over an oil bath. The reaction mixture was cooled and thereto water (250 ml) was added to precipitate crystals. The crystals thus precipitated were filtered off, and washed with water to yield 78 g of the desired compound. Melting Point: 142°–144° C.

(3) Synthesis of Compound (I)-(18):

N-Bromomethylsaccharin (13.8 g), 1-phenyl-3-pyrazolidinone (11.9 g) and triethylamine (5.5 g) were dissolved in tetrahydrofuran (200 ml), and stirred in a stream of nitrogen at room temperature for 2 hours. The reaction mixture was added to water (200 ml), and extracted with 100 ml each of ethyl acetate two times. After drying the extract over anhydrous Glauber's salt, the solvent was distilled away. The thus obtained crude product was recrystallized from ethyl acetate to yield 16 g of N-(1-phenyl-3-pyrazolidinone-2-ylmethyl)saccharin (Compound (I)-(18)). Melting Point: 209°–213° C.

SYNTHESIS EXAMPLE 4

Synthesis of Compound (II)-(2)

(1) Synthesis of N-Bromomethylglutarimide:

Glutarimide (27 g) and a 35% formaldehyde solution (20 ml) were added to water (40 ml), and heated at about 100° C. for 1 hour over an oil bath. The water was completely distilled away from the reaction mixture using a rotary evaporator. Thus, a crude product of N-methylolglutarimide was obtained. This product was added to 200 ml of benzene without purification, and the resulting solution was heated together with phosphorus tribromide (7.5 ml) under reflux for 1 hour. Thereto, water was added and thereby the benzene layer was separated. The crude product obtained by distilling the benzene away from the benzene layer was recrystallized from an ethyl acetate/n-hexane mixture to yield about 25 g of the desired compound. Melting Point: 165° C.

(2) Synthesis of Compound (II)-(2):

N-Bromomethylglutarimide (11.5 g) was dissolved in tetrahydrofuran (50 ml) and thereto a solution of the sodium salt of 1-phenyl-5-mercaptotetrazole (11.5 g) in tetrahydrofuran (50 ml) was added dropwise at room temperature. The reaction mixture was stirred at room temperature for about 1 hour and thereafter the thus precipitated sodium chloride was removed and, further, tetrahydrofuran also was distilled away. The thus obtained crude product was recrystallized from an ethyl acetate/n-hexane mixture to yield 15.5 g of N-(1-phenyl-1-tetrazolylthiomethyl)glutarimide. Melting Point: 84° to 85° C.

The precursors used in the present invention represented by the general formulae (I) to (V), respectively, may be used alone or as a combination of two or more thereof.

The blocked photographic agents (precursors) used in the present invention represented by the general formulae (I) to (V) may be added to any of layers of a silver halide photographic material, e.g., a silver halide emulsion layer, a coloring material layer, a subbing layer, a protective layer, an interlayer, a filter layer, an antihalation layer, an image-receiving layer, a cover sheet layer, and other auxiliary layers. Of these layers, addition to a silver halide emulsion layer is of particular advantage.

In adding the precursors to be employed in the present invention to the above-described layers, the precursors are added to coating compositions for forming the desired layers respectively as they are, or in a form of solutions prepared by dissolving in a solvent which does not adversely affect the photographic material, e.g., water, alcohol, etc., in appropriate concentrations. Also, the precursors can be first dissolved in high boiling point organic solvents and/or low boiling point organic solvents and, further, dispersed in water in the form of an emulsion and then added to the coating compositions. In addition, polymer latexes impregnated with the precursors according to the methods described in Japanese Patent Application (OPI) Nos. 39853/76, 59942/76 and 32552/79, U.S. Pat. No. 4,199,363, and so on may be employed.

The precursors may be added at any stage in the preparation of the photographic material. However, a preferable addition time is generally just before coating.

It is preferred to add the hydroxylamines represented by the general formula (VI) to a processing solution such as a developing solution or the like and to react them with the foregoing precursors having the general formulae (I) to (V) at development. In addition, it is feasible to add in advance at least one hydroxylamine having about 10 or more carbon atoms to a photographic material and to design the hydroxylamine so that it diffuses through layers to react with the foregoing precursors at the time of processing. In this it is desired for the hydroxylamines and the precursors to be added to different layers and for the contact between them to be hindered at the time of coating and upon storage before processing. The hydroxylamines may be added to any layer basically. However, it is preferred to add them to layers other than the silver halide emulsion layers, e.g., a coloring material layer, a subbing layer, a protective layer, an interlayer, a filter layer, an antihalation layer, an image-receiving layer, a cover sheet layer, or other auxiliary layers.

When the hydroxylamines are used by addition to a processing solution, it is preferred to use them as a component of a development processing bath. However, in combinations with the precursors whose photographically useful agents are as a bleach accelerator, a fixation accelerator and a blix accelerator respectively, addition to the pre-bath after the development processing bath or to the corresponding processing bath can produce the effect of the present invention as well.

The present invention can be employed in color photographic materials of, e.g., the coupler system.

In general for forming color images using color photographic materials, silver halide lightsensitive materials are developed with aromatic primary amine type developing agents in the presence of color couplers having the ability to form dyes upon reaction with the oxidation products of the developing agents and thereby azomethine or indoaniline dyes are obtained. The color developing method of this type was invented basically by L. D. Mannes & L. Godowsky in 1935 and thereafter it has undergone various improvements and used prevailingly in the art at the present.

In this method, the subtractive color process is generally employed for color reproduction, and silver halide emulsions sensitized selectively to blue light, green light and red light, respectively, and yellow-, magenta- and cyan-dye forming agents which bear a complementary color relationship to their corresponding emulsions are used in combination. In order to form a yellow dye image, couplers of, e.g., the acylacetanilide type or the dibenzoylmethane type are employed. In order to form a magenta dye image, couplers of the pyrazolone, pyrazolobenzimidazole, cyanoacetophenone or indazolone type are mainly used. In order to form a cyan dye image, phenolic couplers, e.g., phenols and naphthols, are mainly used.

In adding or dispersing these couplers in their corresponding emulsions, well-known conventional methods of addition to gelatin-silver halide emulsions or hydrophilic colloids are employed. For example, the method of mixing couplers with high boiling point organic solvents, such as dibutyl phthalate, tricresyl phosphate, waxes, higher fatty acids or the esters thereof, etc., and dispersing the resulting mixtures into emulsions as described in, e.g., U.S. Pat. Nos. 2,304,939 and 2,322,027; and the method of mixing couplers with low boiling point organic solvents or water-soluble organic solvents, and dispersing the resulting mixture into the emulsions and the method of dispersing couplers using a combination of high boiling point organic solvents and low boiling point solvents as described in, e.g., U.S. Pat. Nos. 2,801,170, 2,801,171 and 2,949,360 can be employed.

Couplers which can be used in combination with the precursors and the hydroxylamines of the present invention include, e.g., the following known couplers.

Specific examples of magenta couplers which can be used include those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, German Pat. No. 1,810,464, German Patent Applications (OLS) Nos. 2,408,665, 2,417,945, 2,418,959 and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76 and 55122/78, and so on.

Specific examples of yellow couplers which can be used include those described in U.S. Pat. Nos. 2,875,057, 3,265,506, 3,408,194, 3,551,155, 3,582,322, 3,725,072 and 3,891,445, German Pat. No. 1,547,868, German Patent Applications (OLS) Nos. 2,219,917, 2,261,361 and 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77 and 115219/77, and so on.

Specific examples of cyan couplers which can be used include those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, German Patent Applications (OLS) Nos. 2,414,830 and 2,454,329, Japanese Patent Application (OPI) Nos. 59838/73, 26034/76, 5055/73, 146828/76, 69624/77 and 90932/77, and so on.

Specific examples of colored couplers which can be used include those described in U.S. Pat. Nos. 3,476,560, 2,521,908 and 3,034,892, Japanese Patent Publication Nos. 2016/69, 22335/63, 11304/67 and 32461/69, Japanese Patent Application (OPI) Nos. 26034/76 and 42121/77, and German Patent Application (OLS) No. 2,418,959.

Specific examples of DIR couplers which can be used include those described in U.S. Pat. Nos. 3,227,554, 3,617,291, 3,701,783, 3,790,384 and 3,632,345, German Patent Applications (OLS) Nos. 2,414,006, 2,454,301 and 2,454,329, British Pat. No. 953,454, Japanese Patent Application (OPI) Nos. 69624/77 and 122335/74, and Japanese Patent Publication No. 16141/76.

In addition to DIR couplers, compounds capable of releasing development inhibitors upon development may be incorporated in a photographic material, and specific examples thereof include those described in U.S. Pat. Nos. 3,297,445 and 3,379,529, German Patent Application (OLS) No. 2,417,914, and Japanese Patent Application (OPI) Nos. 15271/77 and 9116/78.

When the present invention is applied to the color diffusion transfer process, the silver halide photographic material of the present invention can have a film unit structure of the peel-apart type; integrated type as described in Japanese Patent Publication Nos. 16356/71 and 33697/73, Japanese Patent Application (OPI) No. 13040/75, and British Pat. No. 1,330,524, or no peel-apart type as described in Japanese Patent Application (OPI) No. 119345/82.

In every format described above, it is advantageous from the standpoint of broadening the latitude of processing temperature to provide a polymeric acid layer protected by a neutralization timing layer.

The present invention can be also employed in black-and-white photographic materials. Specific examples of black-and-white photographic materials include direct medical X-ray films, black-and-white films for general photographing, lith films, scanner films and so on.

The present invention is not particularly limited in terms of the other constitutions of the silver halide photographic material, e.g., the method of making silver halide emulsions, the halide composition, the crystal habit, the grain size, the chemical sensitizers, the antifoggants, the stabilizers, the surface active agents, the gelatin hardeners, the hydrophilic colloidal binders, the matting agents, the dyes, the sensitizing dyes, the discoloration inhibitors, the color mixing inhibitors, the polymer latexes, the brightening agents, the antistatic agents, etc. As for these aspects, descriptions in *Research Disclosure*, Vol. 176, pp. 22–31 (December, 1978) and so on can be referred to.

The present invention is not particularly restricted as to exposure method for the silver halide photographic material, the developing method thereof and so on, and any known processing method and any known processing solution, as described in *Research Disclosure*, Vol.

176, pp. 28–30 (December, 1978), can be employed in the present invention. This photographic processing may be either a photographic processing for forming a silver image (black-and-white photographic processing) or a photographic processing for forming a dye image (color photographic processing), depending upon the end-use purpose of the photographic material. The processing temperature is generally in the range of about 18° C. to about 50° C. Of course, temperatures higher than about 50° C. or lower than about 18° C. may be employed.

The developing solution employed for black-and-white photographic processing can contain known developing agents. Suitable developing agents include dihydroxybenzenes (e.g., hydroquinone), 3-pyrazolidones (e.g., 1-phenyl-3-pyrazolidone), aminophenols (e.g., N-methyl-p-aminophenol) and so on and these can be used alone or in combination. The developing solution can generally contain, in addition to the above-described developing agents, known preservatives, alkali agents, pH buffering agents and antifoggants and, optionally, may contain dissolving aids, color toning agents, development accelerators, surface active agents, defoaming agents, water softeners, hardeners, viscosity imparting agents and so on.

The photographic emulsions of the present invention can also be subjected to the so-called "lithographic" development processing, if desired.

Color images can be formed using conventional methods. For instance, a negative-positive process (as described in *Journal of the Society of Motion Picture and Television Engineers,* Vol. 61, pp. 667–701 (1953), and so on); a color reversal process in which a negative silver image is formed by development with a developing solution containing a black-and-white developing agent, uniform exposure or another appropriate fogging treatment is carried out at least onec and subsequently, color development is carried out to provide a positive dye image; a silver dye bleach process in which dye-containing photographic emulsion layers are developed after exposure to produce a silver image, and the dyes are bleached using the resulting silver image as a bleaching catalyst; and so on can be employed.

A color developing solution is, in general, an alkaline aqueous solution containing a color developing agent. Suitable examples of color developing agents which can be used include known aromatic primary amine developers, such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.).

In addition to the above-described color developing agent, those described in L. F. A. Mason, *Photographic Processing Chemistry,* pp. 226–229, Focal Press, London (1966), U.S. Pat. Nos. 2,193,015 and 2,592,364, Japanese Patent Application (OPI) No. 64933/73, and so on may be also employed.

Photographic emulsion layers which have been color development-processed are generally subjected to a bleach-processing. The bleach-processing may be carried out either simultaneously with or separately from a fix-processing. Suitable examples of bleaching agents which can be used include compounds of polyvalent metals such as Fe (III), Co (IV), Cr (VI), Cu (II), etc., peroxy acids, quinones, nitroso compounds and so on.

The present invention is illustrated in greater detail by reference to the following examples.

EXAMPLE 1

Measurement of Acceleration Effect of Hydroxylamine upon Release of Antifoggant from Precursor Thereof In 4 ml of acetonitrile was dissolved $3.2\times10^{-5}$ mole of Compounds (I)–(V) of the present invention as shown in Table 1 below. The resulting solution was added to a mixture of 16 ml of acetonitrile and 20 ml of Britton-Robinson buffer solution (Britton-Robinson buffer solution can be prepared by mixing phosphoric acid, boric acid, acetic acid and sodium hydroxide, and of which pH can be adjusted within a pH range of 1.81 to 11.98), and allowed to react (wherein the pH of the solution was controlled by the buffer solution). After a definite time, acetic acid was added to lower the pH of the reaction mixture to 6.25 and thereby the reaction stopped. The antifoggant released was determined using high-speed liquid chromatography and therefrom the rate constant of the pseudo first-order reaction and, further, the half-life $t_{\frac{1}{2}}$ were evaluated.

The same procedures as described above were used except that $3.8\times10^{-4}$ mole of hydroxylamine was added to 16 ml of acetanilide and thereby the half-life was evaluated. The acceleration effect of hydroxylamine was determined by comparison of the half-life value in the hydroxylamine present present case and that in the hydroxylamine-absent case and, further, compared with effects of known precursors of the kind which release antifoggants without ring-cleavage (Comparison Precursor (A-1) and Comparison Precursor (A-2)). The results obtained are set forth in Table 1 below.

Precursor (A-1)

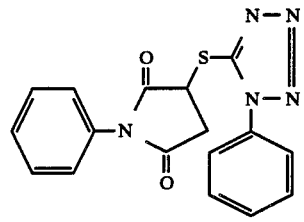

Precursor (A-2)

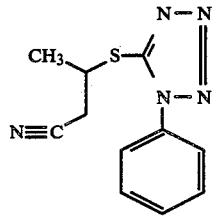

TABLE 1

| Compound No. | pH | $t_{\frac{1}{2}}$ (sec) Hydroxylamine Absent | $t_{\frac{1}{2}}$ (sec) Hydroxylamine Present | Acceleration Effect |
|---|---|---|---|---|
| (I)-(1) | 10.0 | 2,900 | 790 | 3.7 |
| | 11.0 | 340 | 150 | 2.3 |
| (I)-(10) | 10.0 | 320 | 38 | 8.1 |
| | 11.0 | 37 | 12 | 3.0 |
| (II)-(1) | 10.0 | 5,700 | 1,200 | 5.2 |
| | 11.0 | 650 | 260 | 2.5 |
| (I)-(15) | 10.0 | 3,700 | 100 | 37 |
| | 11.0 | 470 | 29 | 16 |
| (I)-(16) | 10.0 | 4,100 | 120 | 35 |
| | 11.0 | 490 | 27 | 18 |
| (III)-(1) | 10.0 | 27,000 | 960 | 29 |
| | 11.0 | 3,300 | 110 | 30 |

TABLE 1-continued

| Compound No. | pH | $t_{\frac{1}{2}}$ (sec) Hydroxylamine Absent | $t_{\frac{1}{2}}$ (sec) Hydroxylamine Present | Acceleration Effect |
|---|---|---|---|---|
| (III)-(14) | 10.0 | 9,000 | 340 | 27 |
| | 11.0 | 980 | 39 | 25 |
| (III)-(5) | 10.0 | 17,000 | 780 | 21 |
| | 11.0 | 2,100 | 87 | 24 |
| (V)-(1) | 10.0 | 53,000 | 2,100 | 25 |
| | 11.0 | 6,200 | 230 | 27 |
| (IV)-(2) | 10.0 | 3,500 | 700 | 5.0 |
| | 11.0 | 420 | 100 | 4.1 |
| Comparison Precursor (A-1) | 10.0 | 2,600 | 4,200 | 0.61 |
| | 11.0 | 310 | 380 | 0.82 |
| Comparison Precursor (A-2) | 10.0 | 25,000 | 23,000 | 1.1 |
| | 11.0 | 2,900 | 2,700 | 1.1 |

As can be seen from the results in Table 1 above, the release of the antifoggant from the precursors represented by the general formulae (I) to (V) were accelerated 2.3- to 37-fold by the addition of hydroxylamine under both a pH of 10.0 and a pH of 11.0. On the other hand, the precursors illustrated as Comparative Precursors (A-1) and (A-2), which release the antifoggant through a reverse Micheal's reaction without ring-cleavage, reduced the releasing speed rather than accelering it, or hardly showed any appreciable change in the releasing speed due to the addition of hydroxylamine.

Accordingly, the acceleration effect of hydroxylamine upon the release by the precursors has turned out to be particularly remarkable in precursors of the kind which release photographically useful agents with a cleavage of a 5- or 6-membered ring containing at least one carbonyl group, such as those represented by the general formulae (I) to (V) in the present invention.

EXAMPLE 2

Measurement of Acceleration Effect on Hydroxylamine upon Release of Pyrazolidones from Precursors Thereof The acceleration effects of hydroxylamine upon release of pyrazolidones were determined in the same way as in Example 1, and the results obtained are shown in Table 2 below.

TABLE 2

| Compound No. | pH | $t_{\frac{1}{2}}$ (sec) Hydroxylamine Absent | $t_{\frac{1}{2}}$ (sec) Hydroxylamine Present | Acceleration Effect |
|---|---|---|---|---|
| (I)-(13) | 10.0 | 9,400 | 2,600 | 3.6 |
| (I)-(14) | 10.0 | 3,200 | 390 | 8.2 |
| (I)-(18) | 10.0 | 9,300 | 440 | 21 |
| (I)-(19) | 10.0 | 7,200 | 370 | 19 |
| (III)-(7) | 10.0 | 13,000 | 450 | 29 |
| (IV)-(5) | 10.0 | 5,600 | 880 | 6.3 |

As can be seen from the results in Table 2, remarkable release-accelerating effects of hydroxylamine were also observed in precursors of the kind which release pyrazolidones with ring-cleavage.

EXAMPLE 3

On a cellulose triacetate film support having thereon a subbing layer was coated the layers described below in the order listed, to which emulsion layer an emulsified dispersion prepared by dissolving one of the antifoggant precursors set forth in Table 3 and Magenta Coupler (C-1) in a mixture of tricresyl phosphate and ethyl acetate and then dispersing the resulting solution into a gelatin aqueous solution was added, to prepare Samples 1 to 15. The coverage of each component is shown in parentheses in terms of $g/m^2$ or $mol/m^2$.

(1) Emulsion layer containing a silver iodobromide negative emulsion (grain size: 1.5μ, silver: $1.6\times10^{-2}$ $mol/m^2$), Magenta Coupler (C-1) ($1.33\times10^{-3}$ $mol/m^2$), tricresyl phosphate (0.95 $g/m^2$) and gelatin (2.5 $g/m^2$).

(2) Protective layer containing the sodium salt of 2,4-dichloro-6-hydroxy-s-triazine (0.05 $g/m^2$) and gelatin (1.30 $g/m^2$).

These films were allowed to stand for 14 hours at a temperature of 40° C. and a relative humidity of 70% and thereafter subjected to sensitometric exposure using white light and, subsequently, to the color development processing (Processing A) described below. The densities of the processed samples were measured using green light to obtain data concerning photographic properties.

| Color Development Processing | Time | Temperature |
|---|---|---|
| 1. Color Development | 3 min 15 sec | 38° C. |
| 2. Bleaching | 6 min 30 sec | " |
| 3. Washing | 2 min | " |
| 4. Fixing | 4 min | " |
| 5. Washing | 4 min | " |
| 6. Stabilizing | 1 min | " |

The processing solutions used in the abovedescribed steps respectively had the following compositions.

| | |
|---|---|
| **Color Developing Solution** | |
| Water | 800 ml |
| 4-(N—Ethyl-N—hydroxyethyl)amino-2-methylaniline Sulfate | 5 g |
| Sodium Sulfite | 5 g |
| Potassium Carbonate | 30 g |
| Potassium Hydrogencarbonate | 1.2 g |
| Potassium Bromide | 1.2 g |
| Sodium Chloride | 0.2 g |
| Trisodium Nitrilotriacetate | 1.2 g |
| Water to make | 1 liter |
| | (pH: 10.1) |
| **Bleaching Solution** | |
| Water | 800 ml |
| Ammonium Ethylenediaminetetraacetonato-ferrate (III) | 100 g |
| Disodium Ethylenediaminetetraacetate | 10 g |
| Potassium Bromide | 150 g |
| Acetic Acid | 10 g |
| Water to make | 1 liter |
| | (pH: 6.0) |
| **Fixing Solution** | |
| Water | 800 ml |
| Ammonium Thiosulfate | 150 g |
| Sodium Sulfite | 10 g |
| Sodium Hydrogensulfite | 2.5 g |
| Water to make | 1 liter |
| | (pH: 6.0) |
| **Stabilizing Solution** | |
| Water | 800 ml |
| Formaldehyde (37% aq. soln.) | 5 ml |
| Fuji Driwell | 3 ml |
| Water to make | 1 liter |

The same processings as Processing A were also used except that color developing solutions prepared by adding 12 g of hydroxylamine sulfate (VI)-(2), 1 g of bis(methoxyethyl)hydroxylamine (VI)-(5) and 6 g of methylhydroxylamine hydrochloride (VI)-(3), respectively, to a 1 liter portion of the color developing solution of Processing A were used. These processings are designated Processing B, Processing C and Processing D, respectively.

The maximum densities of colors developed in each of the above-described Processings A, B, C and D in Samples 1 to 15 are shown in Table 3 below.

TABLE 3

| Sample No. | Antifoggant Precursor | Amount of* Precursor Added | Processing A | B | C | D |
|---|---|---|---|---|---|---|
| 1 (Control) | — | — | 1.41 | 1.23 | 1.06 | 1.25 |
| 2 (Comparison) | B-1 | $5 \times 10^{-3}$ | 1.38 | 1.22 | 1.07 | 1.22 |
| 3 (Comparison) | B-2 | $5 \times 10^{-3}$ | 1.39 | 1.25 | 1.08 | 1.27 |
| 4 (Comparison) | B-3 | $5 \times 10^{-3}$ | 0.88 | 0.86 | 0.87 | 0.88 |
| 5 (Invention) | (I)-(1) | $5 \times 10^{-3}$ | 1.42 | 0.72 | 0.95 | 1.01 |
| 6 (Invention) | (I)-(3) | $5 \times 10^{-3}$ | 1.41 | 0.88 | 0.89 | 1.01 |
| 7 (Invention) | (I)-(11) | $5 \times 10^{-3}$ | 1.40 | 0.84 | 0.96 | 1.08 |
| 8 (Invention) | (I)-(15) | $5 \times 10^{-3}$ | 1.43 | 0.94 | 0.93 | 1.11 |
| 9 (Invention) | (I)-(16) | $5 \times 10^{-3}$ | 1.35 | 0.83 | 0.92 | 1.06 |
| 10 (Invention) | (II)-(1) | $5 \times 10^{-3}$ | 1.41 | 0.80 | 0.97 | 1.05 |
| 11 (Invention) | (II)-(9) | $5 \times 10^{-3}$ | 1.40 | 0.75 | 0.96 | 1.03 |
| 12 (Invention) | (III)-(3) | $5 \times 10^{-3}$ | 1.41 | 0.89 | 0.89 | 1.01 |
| 13 (Invention) | (III)-(17) | $5 \times 10^{-3}$ | 1.42 | 0.88 | 0.89 | 1.02 |
| 14 (Invention) | (IV)-(1) | $5 \times 10^{-3}$ | 1.40 | 0.82 | 0.91 | 1.02 |
| 15 (Invention) | (V)-(1) | $5 \times 10^{-3}$ | 1.41 | 0.85 | 0.93 | 1.03 |

*Amount of precursor added: Molar ratio to silver halide

As can be seen from the results in Table 3, in Samples 2 to 4 for comparison, slight differences between maximum density of color developed with the hydroxylamine-absent Processing A and those of colors developed with the hydroxylamine-containing Processings B to D. On the other hand, in Samples 5 to 15 of the present invention, a great drop in maximum density of developed color was caused by using each of the hydroxylamine-containing Processings B to D. Accordingly, it is apparent that the release of the antifoggant is accelerated by hydroxylamines.

The compounds used herein for comparison and the coupler used herein are illustrated below.

B-1

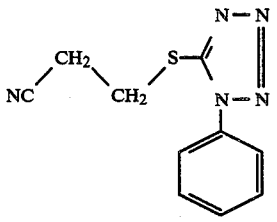

B-2

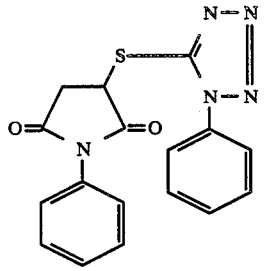

-continued

B-3

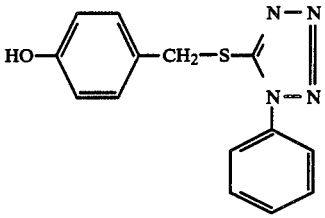

C-1

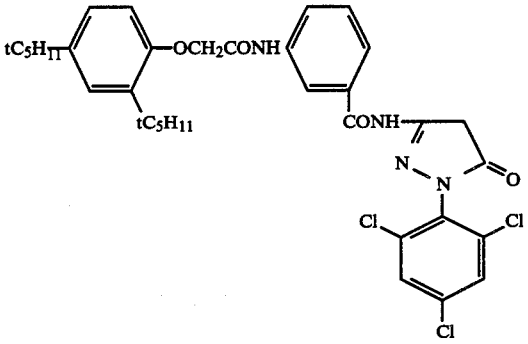

EXAMPLE 4

Coated Samples 16 to 28, each of which contained an antifoggant or a precursor of the antifoggant, were prepared in the same manner as in Example 3. Each of these films was exposed in the same manner as in Example 3 and, subsequently, to color development processing (Processing E) wherein a color developing solution prepared by adding 4.0 g of hydroxylamine sulfate to a 1 liter portion of the color developing solution used in Processing A of Example 3 was used. The photographic properties achieved are shown in Table 4 below.

TABLE 4

| Sample No. | Antifoggant Precursor | Amount of Precursor Added* | Processing A Fog | Relative** Sensitivity | Processing E Fog | Relative** Sensitivity |
|---|---|---|---|---|---|---|
| 16 (Control) | — | — | 0.14 | 100 | 0.13 | 92 |
| 17 (Comparison) B-1 | $2 \times 10^{-5}$ | 0.14 | 100 | 0.13 | 89 | |
| 18 (Comparison) B-2 | $2 \times 10^{-5}$ | 0.14 | 98 | 0.13 | 89 | |
| 19 (Invention) | (I)-(1) | $1 \times 10^{-5}$ | 0.13 | 98 | 0.07 | 89 |

TABLE 4-continued

| Sample No. | Antifoggant Precursor | Amount of Precursor Added* | Processing A Fog | Processing A Relative** Sensitivity | Processing E Fog | Processing E Relative** Sensitivity |
|---|---|---|---|---|---|---|
| 20 (Invention) | (I)-(3) | $2 \times 10^{-5}$ | 0.14 | 99 | 0.08 | 92 |
| 21 (Invention) | (I)-(4) | $2 \times 10^{-5}$ | 0.14 | 99 | 0.08 | 91 |
| 22 (Invention) | (I)-(8) | $5 \times 10^{-5}$ | 0.14 | 99 | 0.07 | 91 |
| 23 (Invention) | (I)-(15) | $2 \times 10^{-5}$ | 0.14 | 100 | 0.09 | 92 |
| 24 (Invention) | (I)-(16) | $2 \times 10^{-5}$ | 0.14 | 100 | 0.08 | 89 |
| 25 (Invention) | (II)-(2) | $2 \times 10^{-5}$ | 0.14 | 100 | 0.10 | 92 |
| 26 (Invention) | (III)-(1) | $1 \times 10^{-5}$ | 0.13 | 98 | 0.08 | 89 |
| 27 (Invention) | (III)-(17) | $5 \times 10^{-5}$ | 0.14 | 100 | 0.09 | 92 |
| 28 (Invention) | (IV)-(1) | $5 \times 10^{-5}$ | 0.14 | 100 | 0.08 | 90 |

*Amount of precursor added: Molar ratio to silver halide

**Relative sensitivity: Standard point of the optical density to determine the sensitivity was fog + 0.2,and the standard sensitivity of antifoggant precursor absent sample (No. 16) was set at 100.

As can be seen from the results in Table 4, every sample showed no change in photographic properties when subjected to hydroxylamine-absent Processing A, while each of Samples 19 to 28, to which the compounds used in the present invention had been added, showed reduction of fog without a reduction in relative sensitivity when subjected to hydroxylamine present Processing E.

While the invention has been described in detail and with reference to specific embodiments thereof, it will be apparent to one skilled in the art that various changes and modifications can be made therein without departing from the spirit and scope thereof.

What is claimed is:

1. A method of processing an imagewise exposed silver halide photographic material, which comprises processing under alkaline conditions, in the presence of a hydroxylamine, an imagewise exposed photographic material containing a light-sensitive silver halide emulsion layer which contains a blocked photographic agent capable of non-imagewise releasing in exposed and non-exposed areas of said light-sensitive silver halide emulsion layer a photographically useful agent by ring cleavage of a 4- to 7-membered ring containing at least one carbonyl group, said blocked photographic agent being a compound represented by the following general formulae (I) to (V):

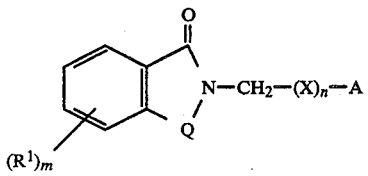

(I)

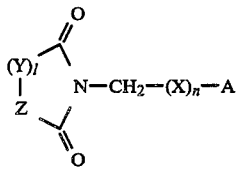

(II)

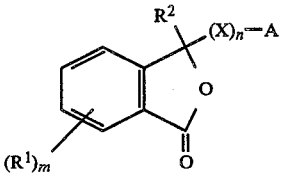

(III)

-continued

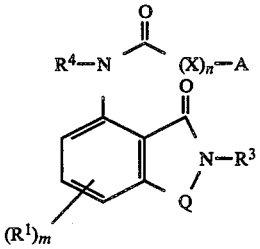

(IV)

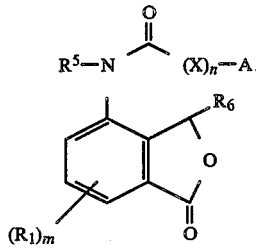

(V)

wherein A represents a photographically useful group which is connected to the blocking group through a hetero atom thereof; Q represents —CO— or —$SO_2$—; X represents a divalent timing group connected to the imidomethyl group through an oxygen atom thereof; $R^1$ represents a substituent on the phenyl nucleus selected from the group consisting of a halogen atom, an alkyl group, an aryl group, an alkenyl group, an alkoxy group, an aryloxy group, an alkylsulfonyl group, an arylsulfonyl group, a secondary or tertiary amino group, a ureido group, an aminosulfonamido group, a carbamoyl group, a sulfamoyl group, a carbonamido group, a sulfunamido group, a carbamate group, an oxycarbonyl group, an acyloxy group, a carbonate group, an acyl group, a carboxy group, a sulfo group, a cyano group and a nitro group; m represents 0 or an integer of 1 to 4; n represents 0 or 1; Z represents —$CR^7R^8$—, —O—, —S— or —$NR^9$—; Y represents the nonmetal atoms necessary to form a 5- to 7-membered ring; l represents 0 or 1; $R^7$, $R^8$ and $R^9$ each represents a substituent selected from the group consisting of a hydrogen atom, a chlorine atom, a bromine atom, an alkyl group, an aryl group, an alkoxy group and an aryloxy group; $R^2$ represents a substituent selected from the group consisting of a hydrogen atom, an alkyl group and an aryl group; $R^3$ and $R^4$ each represents a substituent on the nitrogen atom selected from the group consisting of an alkyl group, an aryl group, an alicyclic group and a heterocyclic ring residue; $R^5$ represents a substituent selected from the group consisting of an alkyl group, an aryl group, an alicyclic group and a heterocyclic ring residue; and $R^6$ represents a substituent selected from the group consisting of a hydrogen atom, an alkyl group and an aryl group.

2. The method of claim 1, wherein said blocked photographic agent is a compound represented by the following general formula (I'), (III) or (V):

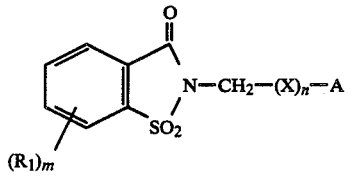

(I')

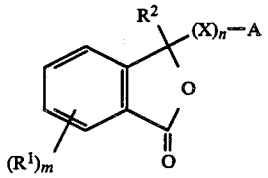

(III)

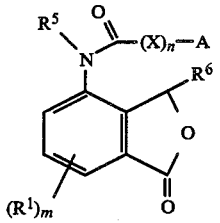

(V)

wherein A, X, $R^1$, $R^2$, $R^5$, $R^6$, m and n each has the same meanings as in claim 2, respectively.

3. The method of claim 1, wherein said method comprises processing said photographic material with a developing solution of a pH of 9 to a pH of 12.

4. The method of claim 1, wherein said processing comprises processing said photographic material with a developing solution containing a hydroxylamine and adjusted to a pH of 9 to a pH of 12.

5. The method of claim 1, wherein said hydroxylamine is represented by the following general formula (VI):

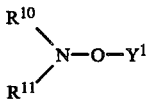

(VI)

wherein $R^{10}$ and $R^{11}$, which may be the same or different, each represents a hydrogen atom, an alkyl group, an alkenyl group, an alkynyl group, an aryl group or a heterocyclic group, or $R^{10}$ and $R^{11}$ may combine and form a ring; and $Y^1$ represents a hydrogen atom or a hydrolyzable group.

6. The method of claim 1, wherein the photographic agent in the photographically useful group represented by A is selected from the group consisting of an antifoggant, a developing agent, an auxiliary developing agent, a fogging agent, a nucleating agent, a silver halide solvent, a bleach accelerator, a blix accelerator, an azo dye, a coloring material for a color diffusion transfer photographic material, and a development inhibitor releasing compound.

7. The method of claim 1, wherein the divalent timing group represented by X is a group which releases the photographic agent by an intramolecular ring-opening reaction, a group which releases the photographic agent through intramolecular electron transfer, a group which releases the photographic agent with the elimination of carbon dioxide or a group which releases the photographic agent with the elimination of formaldehyde.

8. The method of claim 1, wherein the 4-membered to 7-membered ring formed with Y together with Z is selected from the group consisting of succinimide, maleimide, oxazolidinone, thiohydantoin, hydantoin, urazole, parabanic acid, glutarimide, 3-oxyglutarimide, barbituric acid, uracil, benzoxazinedione, dihydroazepine-2,7-dione and a $\beta$-lactam ring.

9. The method of claim 5, wherein the hydroxylamine represented by the general formula (VI) is added to a processing solution.

10. The method of claim 9, wherein $Y^1$ is a hydrogen atom and $R^{10}$ and $R^{11}$ each is a hydrogen atom or an alkyl group containing 1 to 5 carbon atoms, or $R^{10}$ and $R^{11}$ combine and form a ring selected from the group consisting of a pyrrolidine ring, a piperidine ring and a morpholine ring.

11. The method of claim 5, wherein the hydroxylamine represented by the general formula (VI) is added to a silver halide photographic material.

12. The method of claim 1, wherein the blocked photographic agent is contained in the photographic material in an amount of $10^{-9}$ to 10 moles per mole of silver in the silver halide emulsion.

13. The method of claim 9, wherein an amount of the hydroxylamine represented by the general formula (VI) is $10^{-3}$ to 1 mole/l.

14. The method of claim 11, wherein an amount of the hydroxylamine represented by the general formula (VI) is $10^{-7}$ to 1 mole per mole of silver in the silver halide emulsion.

* * * * *